United States Patent [19]

Gotsch et al.

[11] Patent Number: 4,635,732

[45] Date of Patent: Jan. 13, 1987

[54] POWER-DRIVEN HAND-HELD TOOL WITH A PNEUMATIC MOTOR

[75] Inventors: Dieter Gotsch, Grosserlach/Grab; Robert Klenk, Grosserlach-Schönbr.; Otto Häfner, Murrhardt; Claus Süss, Maulbronn, all of Fed. Rep. of Germany

[73] Assignee: Robert Bosch GmbH, Stuttgart, Fed. Rep. of Germany

[21] Appl. No.: 627,741

[22] Filed: Jul. 5, 1984

[30] Foreign Application Priority Data

Sep. 28, 1983 [DE] Fed. Rep. of Germany ..... 3335005

[51] Int. Cl.[4] ..... B25B 21/00

[52] U.S. Cl. ..... 173/162 R; 173/171; 81/57.11

[58] Field of Search ..... 173/DIG. 2, 12, 163, 173/162; 74/785, 801, 803; 418/270, 70; 81/57.11, 57.12, 57.13, 57.14; 73/862.08, 862.09

[56] References Cited

U.S. PATENT DOCUMENTS

| | | | |
|---|---|---|---|
| 2,552,840 | 5/1951 | Burke et al. | 81/57.11 |
| 3,329,185 | 7/1967 | Hettich et al. | 173/163 |
| 3,753,469 | 8/1973 | Tuttle | 173/163 |
| 4,140,446 | 2/1979 | Fernstrom et al. | 418/270 |
| 4,268,233 | 5/1981 | Fernstrom | 418/270 |

*Primary Examiner*—E. R. Kazenske
*Assistant Examiner*—James L. Wolfe
*Attorney, Agent, or Firm*—Michael J. Striker

[57] ABSTRACT

In a power-driven, hand-held tool provided with a pneumatic motor, the stator of the motor is comprised of a central tube of steel and two end flanges of plastics applied onto the central tube by injection molding. The impeller rotor of the motor is supported within the stator and assembled with the stator to form a complete motor assembly which is supported within the cylindrical housing of the tool by means of elastic rings which protect the tool against oscillations. The motor assembly can be assembled and tested outside the tool housing.

6 Claims, 3 Drawing Figures

POWER-DRIVEN HAND-HELD TOOL WITH A PNEUMATIC MOTOR

BACKGROUND OF THE INVENTION

The present invention relates to a power-driven hand-held tool, in which a tool-receiving spindle is rotated by means of a pneumatic motor.

Known hand-held tools of the type under consideration are basically divided into two groups. In one of these groups a specifically high output with a little air consumption is achieved by small manufacture allowances of metal component parts of the pneumatic motor and also by the axial rigging of the components of the pneumatic motor in the housing of the tool for a precisely defined positioning. Such a construction involves high expenses and makes an oscillation-isolated suspension of the pneumatic motor in the tool housing difficult.

In the hand-held tools of another group costly cast iron or plastics component parts are partially combined with simple steel elements. Because of required large plays and tolerances and non-optimal air stream ratio, these motors have a non-satisfactory efficiency and therefore a high pressure air consumption.

The manufacture of such tools has been, however, expensive though an oscillation-isolated suspension of the motor in the tool housing could be easily obtained in the assembled tool.

SUMMARY OF THE INVENTION

It is an object of the present invention to provide an improved power-driven hand-held tool, such as pneumatic screw driver, angle sander or the like.

It is another object of this invention to provide a power-driven tool which has a specifically high yield and a little air consumption.

It is yet another object of this invention to provide a power-driven tool which makes an oscillation-isolated suspension of the pressure air motor within the housing of the hand-held tool possible and easy.

These and other objects of the present invention are attained by a power-driven hand-held tool comprising a housing, a pneumatic motor including a stator having a stator tube formed of steel and two stator flanges made of plastics, said flanges being connected to said stator tube by injection molding, and an impeller rotor positioned in said stator, said stator and said rotor being arranged so that they form a complete motor assembly; and elastic connection means, said complete motor assembly being supported in said housing by said elastic connection means, and said housing and said stator being each provided with plug connection means engageable with each other, said plug connection means securing said motor assembly in said housing against rotation.

It should be noted that manufacturing costs of the power-driven tool according to the invention are lower than those of the conventional tools of the foregoing type. Due to the closed motor assembly provided with the stator tube made from steel and stator flanges from plastics injection-molded on the stator tube, the whole stator can be manufactured with large inlet and output passages inexpensively and very precise.

The tool assembly additionally provides a noise-dampening, oscillation-isolated suspension of the motor in the housing of the tool. Finally, the motor assembly itself can function outside the tool housing. The motor can be inexpensively assembled and tested outside the tool housing.

The stator flanges may be eccentrical relative to said stator tube in a required fashion, said flanges being formed with air inlet passages and air outlet passages and being applied onto said stator tube so that they seal a working space within said stator tube.

The rotor is supported in said stator by ball bearings; at least one of said flanges may be formed with a recess receiving one of said ball bearings.

The stator tube may have a plurality of air outlet openings made by stamping out, which substantially lowers the costs of the manufacturing of the tool.

One of the stator flanges may have a recess provided with an inner thread, in which a supporting member carrying the ball bearing is held.

The plug connection means on the stator may include a plurality of projections formed on one of said flanges and the plug connection means on the housing may include grooves corresponding to said projections and engageable therewith, said projections and said grooves being positioned on said stator and said housing, respectively with coded non-uniformities which permit the insertion of the motor assembly into said housing in only one direction of rotation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
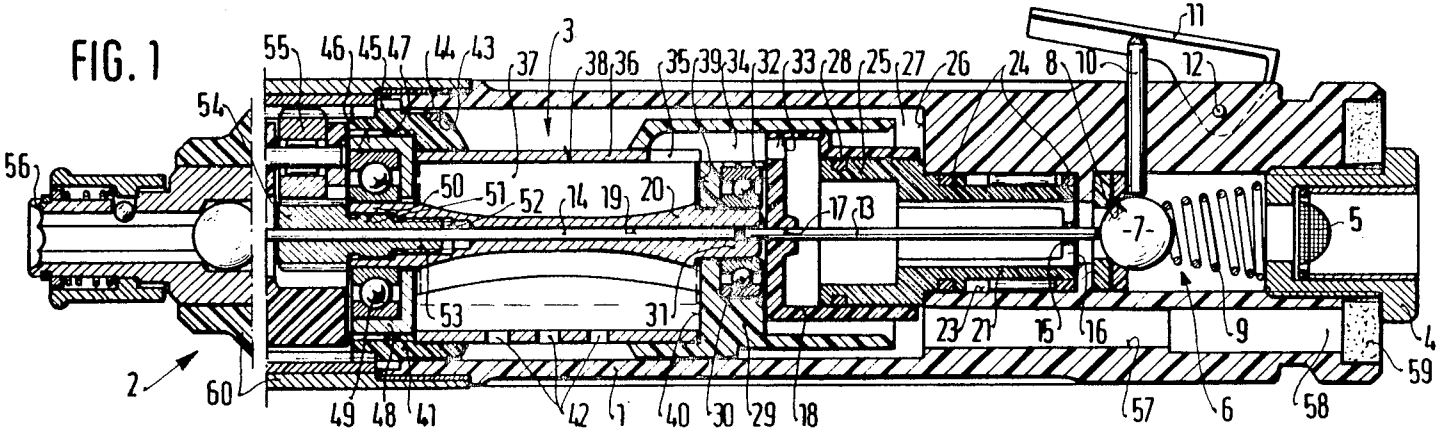
FIG. 1 is an axial sectional view through a tool, specifically a pneumatic screw driver, according to the invention.
Figure 3:
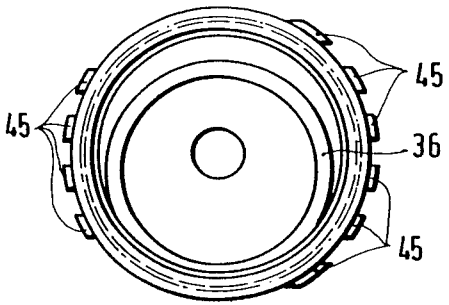
FIG. 3 is a front view of FIG. 2.

Referring now to the drawings in detail the power-actuated portable tool, and more particularly the pneumatic screw driver 2, includes a housing 1 in the rear portion of which, shown in FIG. 1, a pneumatic motor 3 is accommodated. Air supply to motor 3 is carried out by means of a connection 4, which is connected to a non-illustrated air supply hose. A sifter or filter 5, through which air enters the motor 3, is mounted in the interior of connection 4. A valve 6 includes a ball 7 biased by a compression spring 9 in the direction toward motor 3 into a seat 8, and a pin 10. The latter extends radially outwardly from housing 1 and has one end abutting against ball 7 and another end lying against the inner surface of a hand grip 11. The hand grip 11 is formed as a one-arm lever and is pivotally supported on the outer side of housing 1 about a pivot axle 12.

A central driving rod of the motor 3 is formed of two rod portions 13 and 14 which extend one after another in the direction of elongation of the pneumatic screw driver 2. The rod portion 13 is guided at the one end in a small bush 15 and at the other end in a bore 17 formed in a cup-shaped supporting member 18, while rod portion 14 is guided in a longitudinal bore 19 provided in a rotor shaft 20. The right-hand end face of rod portion 13 abuts against the ball 7.

The aforementioned small bush 15 is mounted in a star-shaped supporting portion 16 of a large bush 21 which is positioned in a bore 23 formed in the housing 1. Seal rings 24 encircling bush 21 and axially spaced thereon make the seat of bush 21 in bore 23 air tight. Bush 21 has a collar 25 which extends into an enlarged chamber 27 formed in housing 1. The end wall of collar 25 lies against the base wall 26 of chamber 27. Collar 25 has a circular groove, in which an elastic ring 28, engaged in the cup-shaped supporting member 18, is received. The cup-shaped supporting member 18 is rotatably supported in a stator flange 29 and is mounted in the assembled tool so that it covers a ball bearing 30. The inner ring of ball bearing 30 is positioned on the cylindrical portion 31 of rotor shaft 20 while the outer ring of ball bearing 30 is supported in a receiving opening 32 of stator flange 29. A through opening 33 formed in the bottom of cup-shaped member 18, a passage 34, formed in the stator flange 29 and an inlet opening 35, formed in a stator tube 36, are all formed in registry with each other.

Figure 2:
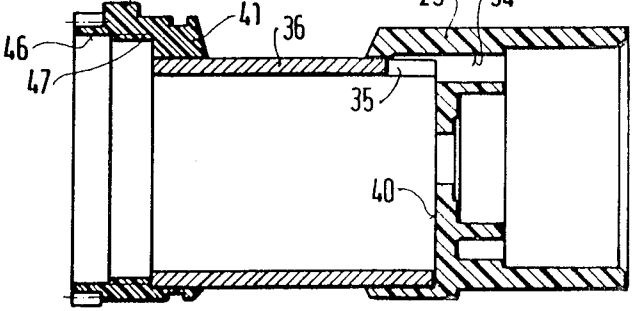
FIG. 2 is an axial view through the stator of the tool in the assembled position.

As most clearly shown in FIG. 2, the stator of motor 3 is formed of the metallic stator tube 36 and flanges 41 and 29 applied onto the ends of stator tube 36. Flanges 41 and 29 are made of synthetic plastic material.

Referring back to FIG. 1 it will be seen that rotor shaft 20 carries in the known fashion a number of impeller blades 37 formed in the star-like fashion as known in the art. Impeller blades 37 have outer edges 38 which tightly lie against the inner surface of stator tube 36. End faces 39 of blades 37 are spaced from the end surface 40 of stator flange 29 at a very narrow gap. Stator flange 29 as well as stator flange 41 are applied onto the outer surface of stator tube 36 by injection molding. In order to ensure a reliable, rigid connection between stator flanges 29 and 41 and stator tube 36 the outer surface of stator tube 36 in the regions of eventual contact with flanges 29 and 41 is preliminarily roughened, for example knurled. In the region of tube 36, free from stator flanges 29 and 41, are formed, for example by stamping-out, perforations 42 which serve as outlet openings for air passing through the impeller. Stator flange 41 has a circular groove 43, in which an elastic ring 44 is inserted. This elastic ring is supported against the cylindrical surface of housing 1, which forms the chamber 27. Non-uniformly distributed teeth 45 are formed on the outer periphery of stator flange 41. Teeth 45 form with corresponding grooves provided in the inner surface of cylindrical housing 1 plug connections by which the whole stator is secured against rotation in housing 1. Due to the non-uniform arrangement of teeth 45 on the outer peripheral surface of flange 41 the stator can slide in housing 1 only in a single predetermined direction of rotation. This is important for the positioning of the air-guiding passages. A recess formed in flange 41 and provided with the inner thread can receive a supporting member 48 which in turn receives a ball bearing 49. The inner ring of ball bearing 49 is positioned on a bush or cylindrical portion 50 of rotor shaft 20, which lies axially opposite to the cylindrical portion 31. A guide bore 51 and a threaded bore 52 are formed in the bush 50. A cylindrical pin 53 of a pinion 54 is threaded into the threaded bore of cylindrical portion 50 of the rotor shaft. Pinion 54 is in mesh with an input gear 55 of the known and non-illustrated transmission for the drive of a tool-receiving spindle 56. The enlarged chamber 27 is connected via an outlet passage 57 to an air discharge opening 58 which leads outwardly of housing 1 via a sound damper 59. The sound absorber 59 is held in housing 1 by connection 4 as well as mesh 5 and the non-illustrated connection hose.

The stator-rotor assembly of pneumatic motor 3 can be manufactured in series with a high precision. Therefore a specifically high output with a corresponding little air consumption are ensured. The stator 41, 36, 29 is supported in housing 1 of the screw driver 2 by elastic rings 28 and 44. The front housing portion 60 receives the gear transmission with input gear 55, tool receiving spindle 56 and the non-illustrated, but known, coupling elements. Due to the provision of elastic support of the stator in the housing by means of elastic rings 28 and 44 the transmission of oscillations from the pneumatic motor 3 to the housing 1 is avoided. This causes a substantial noise reduction. Due to the rigging of the pressure air motor 3 in the housing 1 of the screw driver 2, in addition to the noise reduction, assembling operations are simplified.

The pressure air motor 3 can be assembled and tested outside the housing 1 of the screw driver and then inserted into the housing of the pneumatic screw driver. After opening valve 6 either by means of hand grip 11 or by means of the two-part drive rod 13, 14 actuated upon the application of the tool to a workpiece, pressurized air flows via large bush 21, through opening 33, passage 34 and the inlet opening 35 into the interior of stator tube 36. Via impeller blades 37 incoming air rotates rotor shaft 20, and then this air, via perforations 42, flows into chamber 27 and from thence, via outlet passage 57 and outlet opening 58 with noise damper 59, air exits outwardly. The so-generated rotation of rotor shaft 20 is translated via pinion 54 to the input gear 55 of the non-illustrated gear transmission and finally to the tool-receiving spindle 56 with the corresponding screw driver tool.

It will be understood that each of the elements described above, or two or more together, may also find a useful application in other types of power-driven hand-held tools differing from the types described above.

While the invention has been illustrated and described as embodied in a power-driven hand-held tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A power-driven, hand-held tool, comprising a housing; a pneumatic motor including a stator having a stator tube formed of steel and an annular stator flange made of plastic mounted to each end of said tube and extending axially, said flanges being connected to said stator tube therefrom by injection molding, and an impeller rotor positioned in said stator tube, said stator and said rotor being arranged so that they form a complete motor assembly; an elastic supporting means carried by the outer peripheral surface of one of said flanges said complete motor assembly being supported in said housing by said elastic supporting means being positioned between said one flange and the inner peripheral surface of said housing; said housing and said one flange each being provided with a plug connection means formed directly therewith and of one piece with said housing and said one flange, respectively, and engageable with each other, said plug connection means securing said motor assembly in said housing against rotation.

2. The tool as defined in claim 1, wherein said flanges are eccentrical relative to said stator tube in a required fashion, said flanges being formed with air inlet passages and air outlet passages and being applied onto said stator tube so that they seal a working space within said stator tube.

3. The tool as defined in claim 1, wherein said rotor is supported in said stator tube by ball bearings, at least one of said flanges being formed with a recess receiving one of said ball bearings.

4. The tool as defined in claim 1, wherein said stator tube has a plurality of air outlet openings stamped out in said tube.

5. The tool as defined in claim 1, wherein said rotor is supported in said stator tube by ball bearings, one of said flanges having a recess provided with an inner thread; and further including a supporting member, said supporting member carrying one of said ball bearings and being held in said recess by the inner thread thereof.

6. The tool as defined in claim 1, wherein said plug connection means on said one flange includes a plurality of projections formed on said one flange and the plug connection means on said housing includes grooves corresponding to said projections, and said projections and said grooves being positioned on said one flange and said housing, respectively, with coded non-uniformities which permit the insertion of the motor assembly into said housing in only one direction of rotation.

* * * * *